United States Patent [19]

Cayzac

[11] 4,236,180

[45] Nov. 25, 1980

[54] MONITORING SYSTEM FOR MONITORING A FIELD

[75] Inventor: Jacques C. Cayzac, La Varenne St Hilaire, France

[73] Assignee: U.S. Philips Corporation, New York, N.Y.

[21] Appl. No.: 11,581

[22] Filed: Feb. 12, 1979

[30] Foreign Application Priority Data

Feb. 27, 1978 [FR] France ..... 78 05513

[51] Int. Cl.[3] ..... H04N 7/18

[52] U.S. Cl. ..... 358/105

[58] Field of Search ..... 358/105

[56] References Cited

U.S. PATENT DOCUMENTS

| | | | |
|---|---|---|---|
| 3,049,588 | 8/1962 | Barnett | 358/105 |
| 3,603,729 | 9/1971 | Sperber | 358/105 |
| 3,740,466 | 6/1973 | Marshall | 358/105 |
| 3,743,768 | 7/1973 | Copland | 358/105 |
| 3,811,010 | 5/1974 | Long | 358/105 |
| 4,112,463 | 9/1978 | Kamin | 358/105 |
| 4,148,062 | 4/1979 | Kamin | 358/105 |

*Primary Examiner*—Howard W. Britton

*Attorney, Agent, or Firm*—Thomas A. Briody; William J. Streeter; Edward W. Goodman

[57] ABSTRACT

Monitoring system particularly for detecting the presence of moving persons in a monitored area.

This system comprises two detection stages 2 and 22, two processing stages 3 and 23 and a selective switching-on stage 4 which the two groups of stages 2, 22 and 3, 23 have in common. Each one of the detection stages 2 and 22, which comprise cameras 7 and 27, respectively, send field signals to the associated processing stages, these signals corresponding with the observed images. Each processing stage sequentially compares the signal values in the field signals which the stage receives in accordance with a controllable pre-determined rhythm, whereafter it sends comparison signals, whose number is proportional to the magnitude of the observed motion by comparing the field signals, to the switching-on stage 4. When the sum of the two numbers of signals received by the switching-on stage 4 is greater than the threshold value present in the threshold circuit an intervention device 17 is actuated.

Use: Protecting rooms from burglary or hold-ups. Reference: FIG. 1.

6 Claims, 5 Drawing Figures

MONITORING SYSTEM FOR MONITORING A FIELD

BACKGROUND OF THE INVENTION

The present invention relates to a monitoring system for monitoring a field, particularly for the detection of motion of objects within a given area, the system comprising a detection stage provided with a camera for signal recording with respect to the area to be monitored, a processing stage provided with a storage device and a comparison circuit for producing comparison signals in dependence on signal differences and signal agreements, respectively, between signals produced by the camera and delayed and not delayed in the storage device and comprising a selective switchin-on stage having an intervention device actuacted in dependence on the number of comparison signals.

Such a motion detection system is disclosed in U.S. Pat. No. 2,493,543 and is mainly used in the field of protecting rooms from burglary or hold-ups.

Generally, the monitoring systems of a more simple nature are rather limited in range (for example devices operating with an infra-red beam) and can be easily avoided by persons to whom the presence and the mode of operation of the system is known. Consequently, the efficiency of such systems is often very poor.

To monitor a large-size area, use can be made of more elaborate systems using one or more cameras, but usually such systems require the presence of an operator for the interpretation of the result of the observation and the resultant proper decisions. In addition, it is possible to use automatic detection systems of the radar type which operate at a very high frequency. However, these systems are sensitive to parasitic signals and are therefore subject to untimely reactions.

On the other hand, none of the existing monitoring systems can distinguish between moving objects in the monitored area on the basis of their dimensions (the word "object" is used here in the most general sense: it may relate to a person, an animal or any object which performs a certain motion under the influence of a certain action). So these systems may not only start operating when a person moves into this area but also at a very untimely moment, for example when an animal passes by.

SUMMARY OF THE INVENTION

It is an object of the invention to provide a monitoring system which is efficient as well as insensitive to parasitic signals and which, without requiring the presence of an operator, is able to perform a given selection on the basis of the dimensions of objects moving in the monitored area, before actuating another alarm device or an device.

The invention therefore relates to a monitoring system characterized in that the system comprises at least two cameras, each being arranged at a different angle with respect to the area to be monitored by the cameras, each camera being connected through a processing stage to said, single, selective switching-on stage in which the comparison signals, derived from the different camera signals added together, determine whether the intervention device must be actuated.

A preferred embodiment of a monitoring system is characterized in that two cameras are arranged in a more or less opposite direction with respect to the area to be monitored.

A preferred embodiment comprising more than two cameras is characterized in that the system comprises four cameras which are successively arranged at square angles with respect to the area to be monitored.

The result of adding the comparison signals together can be most simple illustrated with reference to the system embodiment having two cameras arranged more or less oppositely to one another.

Let first the case be considered of an object which moves substantially parallel to the axis connecting the two oppositely arranged cameras. If this object moves away from one camera it approaches the other camera and vice versa. This causes the result of the total count performed by the selective switching-on stage to vary less with the distance between the moving object and each camera than when only one single camera is present, since the number of comparison signals produced, for example, by a first processing stage connected to the first camera which is approached by the object, is compensated for by the number of comparison signals produced by the other processing stage.

In an embodiment having a higher degree of perfection the invention comprises an arrangement for neutralizing the influence of the mutual distances between a moving object in the monitored area and each individual camera on the result of the count of the total number of comparison signals, this arrangement comprising an evaluation circuit suitable for deriving from a counter the number of comparison signals, which are supplied sequentially or simultaneously by one common or two separate processing stages, respectively, and for determining, in dependence on the two values thus derived, a coefficient which is inversely proportional to the mathematical expression of the total number of comparison signals present at the output of the counter as a function of the mutual distances which are at right angles to the axis between the two cameras, between the moving object and each individual camera, and comprising a correction circuit suitable for multiplying this mathematical expression of the total number of comparison signals by this coefficient.

By fully suppressing the influence of the distance between the moving object and the cameras on the counting result, it is possible to have the threshold value accurately correspond with the dimensions of the object below which actuation of the intervention device is not considered useful. The monitoring system thus realized ensures in an efficient manner that the intervention device is actuated when an object appears and moves around in the monitored area, but this actuation is only enabled after a careful check whether the dimensions of the object exceed a preset threshold value. This renders untimely actuation, which occur in the prior art monitoring systems, impossible.

DESCRIPTION OF THE DRAWINGS

The invention will be further explained by way of non-limitative example with reference to the accompanying drawings.

DESCRIPTION OF THE PREFERRED EMBODIMENT

Figure 1:
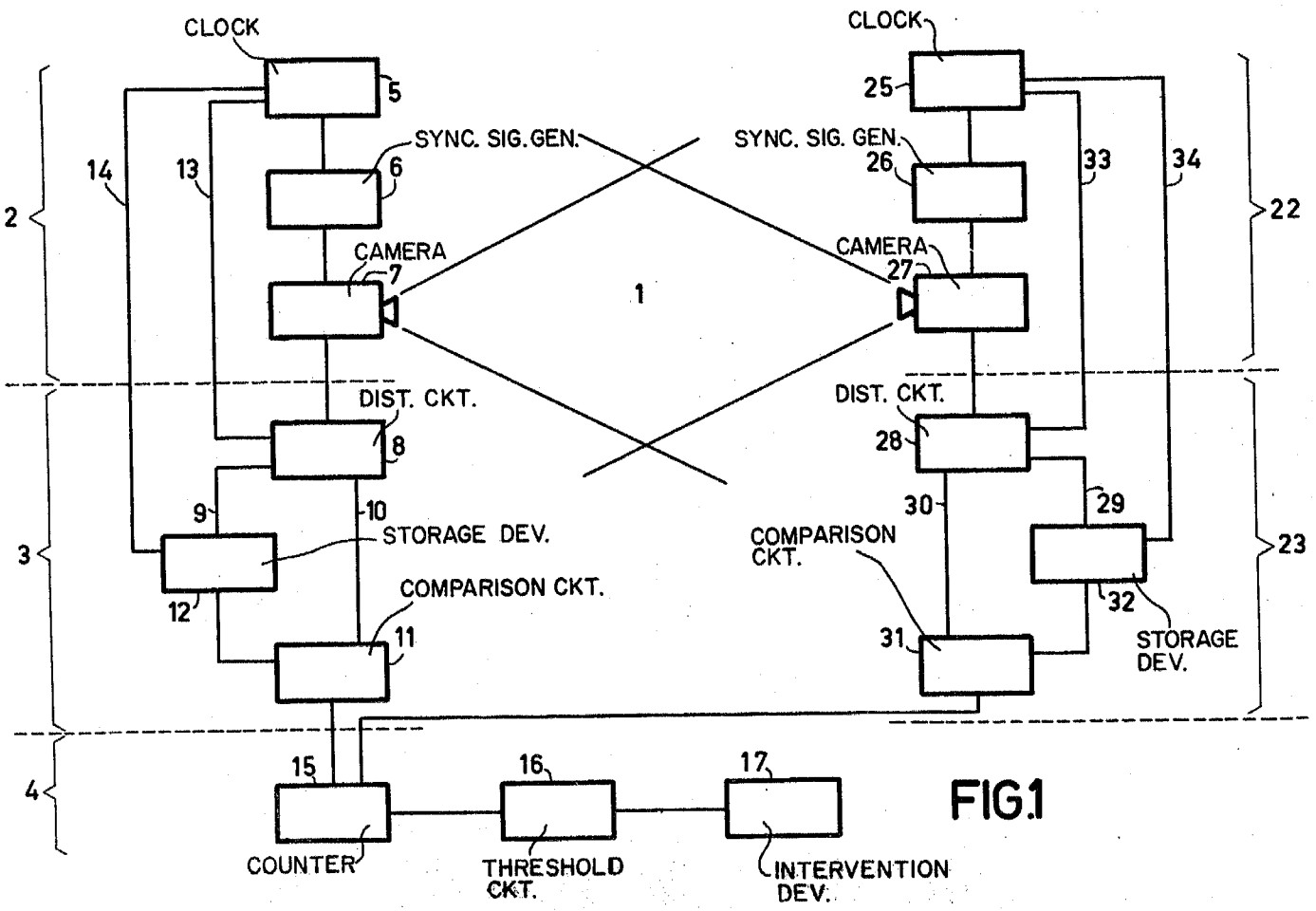
FIG. 1 shows an embodiment of a monitoring system according to the invention.

The monitoring system shown in FIG. 1 has for its purpose to observe motions which may occur within a monitored area 1. The field to be monitored may be a room which must be protected from robbery or burglary (a house, the till of a bank) or, in a public place, such as a museum, the immediate surroundings of an exhibited valuable object, or the area surrounding a certain installation (electric apparatus operating with a very high tension, storage of dangerous products).

To this end the monitoring system according to the invention consists of detection stages 2 and 22, respectively, processing stages 3 and 23, respectively, and a selective switching-on stage 4, which are arranged in series and will be described in greater detail in the following description.

The detection stage 2 consists of a clock circuit 5, a synchronizing signal generator 6 controlled by this clock circuit and a camera 7 for converting an image the camera 7 observes into electric signals at intervals determined by the generator 6. These signals are obtained by line sequentially scanning the observed image, each of these lines selecting a given number of points analyzed consecutively during scanning (in the manner of a sampling procedure). An analog output signal whose amplitude depends on the luminous strength originating from the observed image corresponds to each point analyzed in accordance with this sampling procedure. The total number of points and therefore analog electric signals obtained after this sampling procedure is in relation to the definition of the camera. A somewhat expensive embodiment of the monitoring system uses for example, a camera which scans the image in 50 lines each having 50 elements; the number of lines and elements per line may, however, differ depending on the desired definition and the accuracy of the analysis. For the remaining part of this description, and only for the simplicity thereof, it will be assumed that scanning is effected line-sequentially and that no interlacing is performed, as customary for television. The totality of sampled electric signals obtained after each scan of an image is called the field signal and the camera produces periodically consecutive field signals which correspond to consecutively observed images; the sequential frequency of the fields of the field frequency is, generally, 25 or 50 fields per second, but may differ.

In the embodiment of the invention described herein, the frequency opted for is 25 fields per second and each field signal includes a fixed series of 2500 analog electric signals which correspond to 2500 elements which are consecutively inspected during scanning of a picture, that is to say in 1/25 second. The clock circuit 5 produces a series of pulses having a period of 16 microseconds, which represents the frequency in which the analyzed elements follow one another (62,500 Hertz) or, in other words, the sampling frequency. By means of frequency division this same clock circuit 5 produces a series of pulses having a period of 800 microseconds or 0.8 millisecond, which determines the frequency in which the scanning lines follow one another (1250 Hertz) or, in other words, the line frequency. After a second frequency division, circuit 5 also produces a series of pulses having a cycle of 40 milliseconds, which determines the field frequency (25 Hertz). These signals having the frequency 62,500, 1250 and 25 Hertz, respectively, are passed on to the synchronizing signal generator 6 which applies synchronizing signals to the camera 7 to enable a proper scanning of the observed image. The sampling frequency is determined by the signal having a frequency of 62,500 Hertz; the change from one scanned line to the next line is controlled by the signal having the frequency of 1250 Hertz, and that of a subsequent field by the signal having a frequency of 25 Hertz. For simplicity, the times required for the transition from the end of a line to the beginning of the next line and from the end of a field to the beginning of the next field are ignored in the present description.

The processing stage 3, which receives at its input the field signals which are supplied sequentially by the detection stage 2, comprises the series arrangement of a distribution circuit 8 for the successive fields, a group of two parallel channels 9 and 10 through which the field signals pass which are applied to these channels by the distribution circuit 8, and a comparison circuit 11 having two inputs connected to the outputs of the channels 9 and 10, respectively.

On receipt of the signal of a certain field (denoted the first field here) produced by the camera 7, the distribution circuit 8 directs the first field signal to one of the two parallel channels, which is denoted "storage channel" 9. This channel 9 is provided with a storage device 12 of the analog type which receives and stores the first field signal. On receipt of a succeeding field signal (at a later moment than the first field and which is therefore denoted the second field hereinafter, it not being necessary for it to follow the first field immediately) the distribution circuit 8 directs this second field signal to the other parallel channel, which will be denoted the "immediate-transfer channel" 10. When the second field signal passes through the immediate-transfer channel 10 to appear thereafter at the corresponding input of the comparison circuit 11, the storage device 12 releases the stored information and the first field signal appears at the corresponding input of the comparison circuit 11 at the same moment the second field signal appears at the second input. So the comparison circuit 11 receives simultaneously at each of its two inputs the signal of the same order of the first field, shifted in time, and the second field and after having compared them, the comparison circuit 11 supplies a comparison signal at its output only when the signals of the same order of each of the two fields are different.

If m is the order of the first field (for example from the instant at which the monitoring system operates) and $m+i=n$ is the order of the second field it is clear that i may then assume any value. If, for example, two fields, which are shifted over one fifth of a second, must be compared with one another, i is chosen equal to 5, as the fields succeed one another every twenty-fifth of a second in the embodiment described here. This means that after having sent the signal of the field m into the storage channel 9 where this signal is temporarily stored in the storage device 12, the distribution circuit 8 does not pass the signals of the four subsequent fields having the order $m+1$, $m+2$, $m+3$ and $m+4$, but when the field signal having the order m+5 is received the distribution circuit 8 passes this signal on to the immediate-transfer channel 10. The presence of a field signal in the channel 10 actuates the display of the first field signal by the store 12, at the same time actuating the comparison which was described in detail in the foregoing. After the comparison process has ended the distribution circuit 8 performs the same processes again by selecting a fresh first field, for example having order p=n+k, wherein k=3, and a fresh second field, for example having the order n+k+i, where i is always equal to 5. The "first fields" which are consecutively sent into the storage channel 9 have, therefore, the order m, m+8, m+16, etc., and the "second fields" consecutively sent into the immediate-transfer channel 10 have the order n (=m+5), n+8, n+16, etc. The frequencies at which fields follow one another can be easily attained by frequency division by means of the clock circuit 5 of the detection stage 2. To this end a control line 13 connects the clock circuit 5 to the distribution circuit 8. Likewise, a control line 14 connects the circuit 5 to the storage device 12 to enable the latter to display the first field signal and to pass it on to the second input of the comparison circuit 11, precisely at the moment at which the second field signal passes through the immediate-transfer channel 10 and appears at the second input of the comparison circuit 11.

Figure 2:
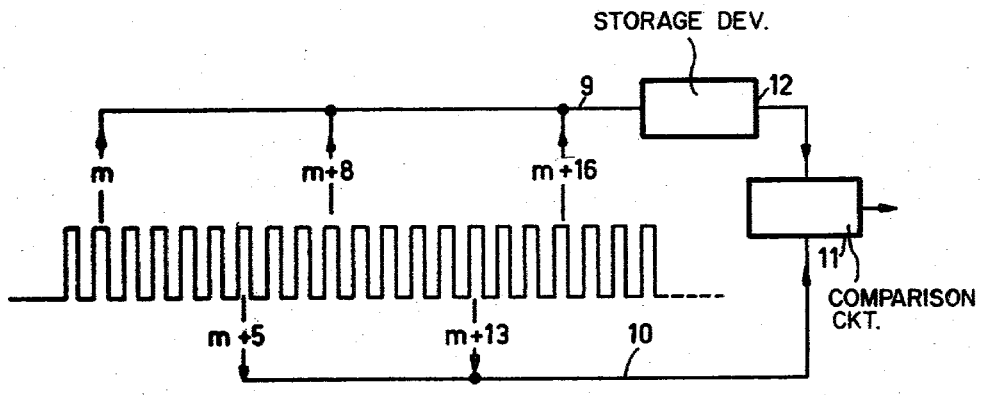
FIG. 2 is an example of the use of the scanning signals consecutively produced by a detection stage.

FIG. 2 clearly shows the use which can be made of the consecutive fields in the special case described above. The signals of the fields m, m+8, m+16 etc. are sent into the storage channel 9 by assuming, for example, that entering a field signal in the storage device 12 erases the preceding field signal, or that the display of the field written in by this storage device 12 destroys at the same time the content of the storage device. The signals of the field m+5, m+13, m+21 etc. are sent into the immediate-transfer channel 10. At the two inputs of the comparison circuit 11 there appear simultaneously the signals of the fields m and m+5, respectively, thereafter of the fields m+8 and m+13, respectively, thereafter of the fields m+16 and m+21, respectively, etc.

The selective switching-on stage 4, which receives at a first input thereof the comparison signal sequentially supplied by the processing stage, includes the series arrangement of a counter 15, a threshold circuit 16 and an intervention device 17. The counter 15 receives the comparison signals and counts them. When (and in that case only) the signal obtained at the output of the counter 15 is greater than a predetermined threshold value stored in the threshold circuit 16, a switching-on signal appears at the output of the threshold circuit 16 which switching-on signal actuates the intervention device 17.

The threshold circuit 16 can be of the analog or of the digital type. If it is of the analog type the counter 15 passes a series of pulses on to a capacitor wherein the amplitude values of the pulses are added together until the capacitor voltage reaches the predetermined threshold value; if it is of the digital type the number of the pulses supplied by the counter 15 is compared with the number of pulses constituting the threshold value written into the threshold circuit 16. The counter 15 and the threshold circuit 16 can periodically be reset to zero by means of, for example, a connection (not shown) between the clock circuit 5 and the counter 15 and the threshold circuit 16 in order to transfer an "end-of-field" signal to that threshold circuit.

Depending on the circumstances the intervention device 17 can be a simple alarm device or an arrangement comprising means to react to the special situation caused by the actuation of the device (the intervention device 17 can, for example, ensure that armoured shutters are closed). When the intervention device 17 is an alarm device it generally operates continuously, even after the switching-on signal, which actuated it, has disappeared; the intervention of a third person, who must, for example, depress a push-button, is required to interrupt its operation.

According to the invention the monitoring system further comprises the second detection stage 22 and the second processing stage 23 which are identical to the first detection stage 2 and the first processing stage 3, respectively. The second detection stage 22 comprises a clock circuit 25, a synchronizing signal generator 26 and a camera 27, whereas the second processing stage 23 comprises a series arrangement of a distribution circuit 28, a group of two parallel channels, consisting of a storage channel 29 and an immediate-transfer channel 30, a comparison circuit 31 and a storage device 32 included in the storage channel 29. Control lines 33 and 34, which are identical to the lines 13 and 14, connect the clock circuit 25 to the distribution circuit 28 and the storage device 32, respectively. In the example of FIG. 1 the camera 27 is located opposite to the camera 7 of the first detection stage 2, substantially on the optical axis and at the other side of the area 1 to be monitored relative to this camera 7. Instead of observing the area 1 to be monitored from the opposite direction at an angle of 180°, the cameras 7 and 27 may alternatively observe the area at other angles which, however, must sufficiently deviate from 0°.

The two additional stages 22 and 23 are connected in the same manner as the first detection stage 2 and the first processing stage 3, respectively, and will therefore not be described in detail. The output of the second processing stage 23 is connected to a second input of the selective switching-on stage 4 which the two groups of stages 2, 3 and 22, 23 have in common. The counter 15 produces at the output a number which is equal to the total number of comparison signals supplied by the two processing stages 3 and 23 and, as earlier in this description, this number of signals is compared in the threshold circuit 16 with a threshold value present in this circuit.

The signals passing through the stages 2 and 3 and the signals passing through the stages 22 and 23 are preferably in synchronism, but the operation of the monitoring system is not changed in an absolute sense if the sampling frequency of the signals is different in the two groups of stages.

Figure 3:
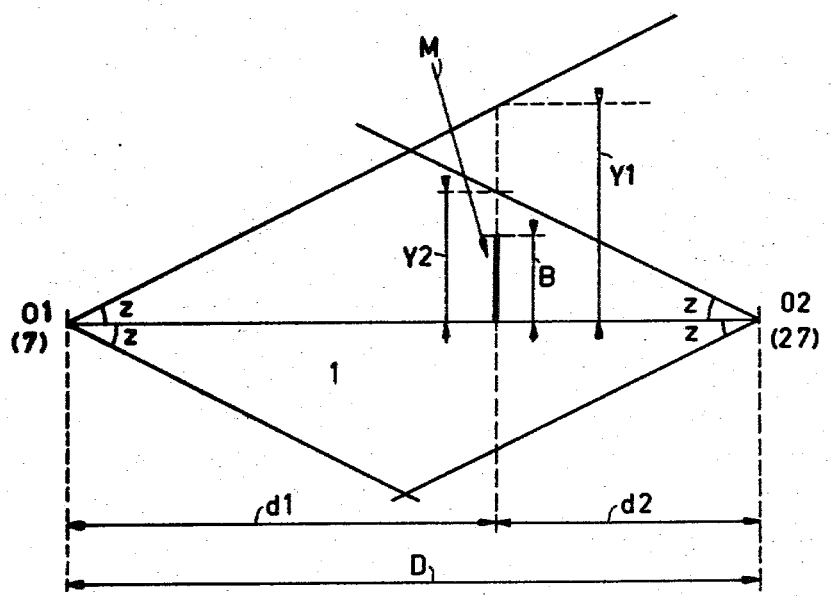
FIG. 3 represents the area monitored by cameras of the monitoring system of FIG. 1.

FIG. 3, which is a detailed illustration of the area 1, which is monitored by the cameras 7 and 27 of the monitoring system of FIG. 1, renders it possible to determine the quantities which are important for the computation of the number of comparison signals counted by the counter 15. Herein:

D=distance between the objectives O1 and O2 of the cameras 7 and 27;

d1=the distance perpendicularly projected to D between a moving object M and the camera 7;

d2=the distance perpendicularly projected to D between this object M and the camera 27 (so d1+d2=D);

a=d1/D=1−d2/D (the coefficient is situated between 0 and 1);

B=the dimension of the object M perpendicularly to the distance D;

N=the total number of elements of a scanned line;

Y1=the width of the monitored area 1 at the distance d1 from the camera 7;

Y2=the width of the monitored area 1 at the distance d2 from the camera 27;

z=half the angle at which the monitored area 1 is observed by each of the cameras 7 and 27.

The number of elements corresponding to the recorded size of the moving object of a field scanned by the camera 7 through the objective O1 and of a field scanned by the camera 27 through the objective O2 are denoted N1 and N2, respectively. These numbers N1 and N2 are obtained after an element-by-element comparison of the fields in the processing stages 3 and 23, respectively, and are equal to the numbers of comparison signals produced by the respective processing stages. It is assumed that Nt represents the total number of counted comparison signals applied to the threshold circuit 16, it holding that:

$$Nt = N1 + N2$$
$$N1 = N\frac{B}{Y1} = N\frac{B}{d1 \cdot \tan z} = N\frac{B}{a \cdot D \cdot \tan z}$$
$$N2 = N\frac{B}{Y2} = N\frac{B}{d2 \cdot \tan z} = N\frac{B}{(1-a) \cdot D \cdot \tan z}$$

Replacing the constant part of N1 and N2 by a constant C furnishes:

$$N1 + N2 = \frac{C}{a} + \frac{C}{1-a} \text{ where } C = \frac{N \cdot B}{D \cdot \tan z}$$
$$\text{or: } Nt = N1 + N2 = \frac{C}{a(1-a)}$$

So it appears that the total number Nt of comparison signals supplied to the counter 15 by the processing stages 3 and 23 can be expressed in a very simple manner as a function of the distances d1 and d2 or, which is the same, of the coefficient a=d1/D. This function Nt=f(a) is of a known type. The graphic representation thereof in the form Nt/C, shown in FIG. 4, comprises a central flatter section and two symmetrical sections which approach asymptotes (the asymptotes being given by the straight lines a=0 and a=1). The curve thus shown corresponds to a certain value of the size B of the object M(C=N·B/D·tan z). For the other values of B curves are obtained which are shifted upwards or downwards in parallel.

The essential advantage of the monitoring system as shown in FIG. 1 is obvious now:

The cameras 7 and 27 must be situated so that the monitored area 1 through which a moving object M can pass, corresponds to the flatter, central portion of the curve Nt/C=f(a), that is to say in the center of the axis between the two cameras and thus that a=½ is situated in the center of the really useful monitoring section of the monitored area 1, causing the value Nt/C and, consequently, the number Nt to vary only little with respect to the distance between the moving object and the cameras. This improvement with respect to monitoring systems having only one camera for each area is due to the fact that the number N1 is brought to equilibrium by the number N2 or, vice versa N2 to N1, whatever the case may be. As a result thereof Nt varies more slowly as a function of a than N1 or N2 separately. By way of comparison, FIG. 4 shows the curve N1/C=f(a) and N2/C=f(a) by means of dotted lines.

Figure 4:
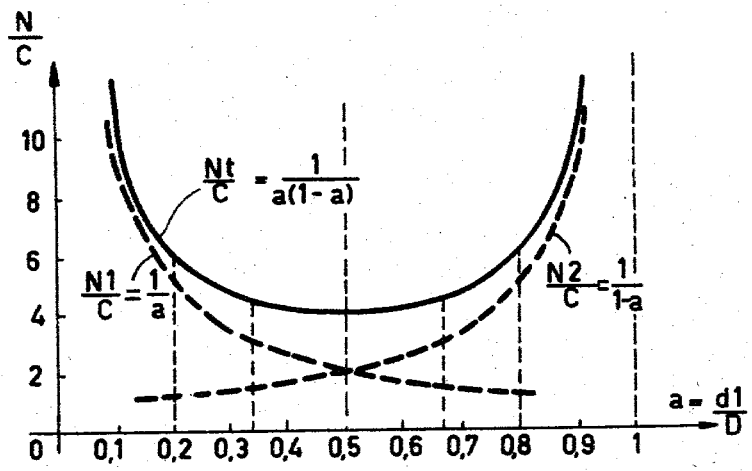
FIG. 4 is a graphic representation of the curve of the total number of comparison signals as a function of the position of a moving object detected in the monitored area by the monitoring system of FIG. 1.

In the example the cameras 7 and 27 are arranged at an angle of 180° with respect to the area 1, with which the computation given for the FIGS. 3 and 4 is associated. A similar computation can be performed for other angles which, however, must deviate to a sufficient extent from the 0° angle to obtain the advantageous effect.

Figure 5:
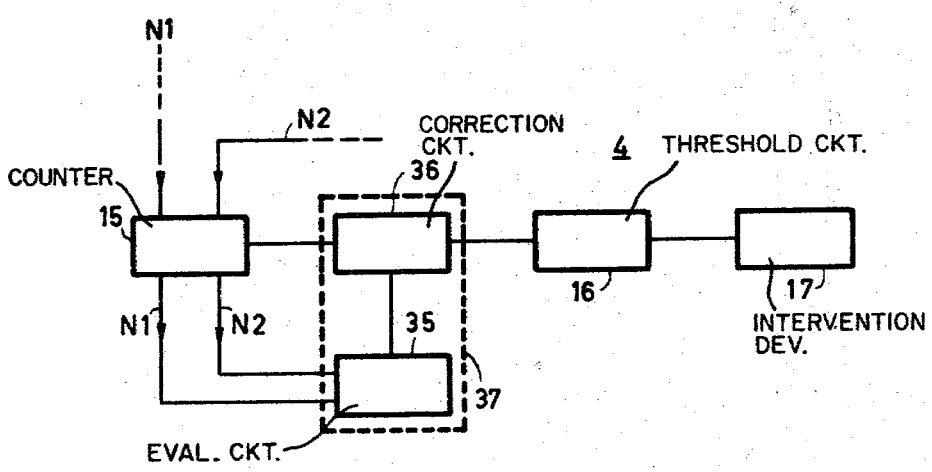
FIG. 5 shows an arrangement for neutralizing the influence of the distance between the object and the cameras on the counting result, this arrangement being included in a selective switch-on stage of the monitoring system of FIG. 1.

The monitoring system shown in FIG. 1 can be perfected by adding an arrangement 37 (FIG. 5) to the selective switching-on stage 4 to neutralize the influence of the mutual distances between the moving object and each one of the cameras 7 and 27. The stage 4 thus modified is shown in FIG. 5 and, in addition to the counter 15, the threshold circuit 16 and the intervention device 17, this stage 4 comprises an evaluation or value—determining circuit 35 and a correction circuit 36 which together constitute the neutralizing arrangement 37.

From the expression of N1, calculated earlier in this description:

$$Nt = \frac{C}{a \cdot (1-a)}$$

it appears that it suffices to multiply Nt by a·(1−a) or by a coefficient which is in proportion to a·(1−a) in order to make Nt fully independent of the value of a (and so from the instantaneous position of the moving object), where a=d1/D (FIG. 3). As the value of a remains unknown throughout the procedure, the neutralizing arrangement 37 must try to determine this value:

$$C = a \cdot N1 = (1-a) \cdot N2$$
$$\frac{N1}{N2} = \frac{1-a}{a} = \frac{1}{a} - 1$$
$$\frac{1}{a} = 1 + \frac{N1}{N2} = \frac{N1 + N1}{N2} = \frac{Nt}{N2}$$
$$a = \frac{N2}{Nt}$$
$$1 - a = 1 - \frac{N2}{Nt} = \frac{Nt - N2}{Nt} = \frac{N1}{Nt}$$
$$a \cdot (1-a) = \frac{N1 \cdot N2}{(Nt)^2} = \frac{N1 \cdot N2}{N1^2 + N2^2 + 2 \cdot N1 \cdot N2}$$
$$a \cdot (1-a) \quad \frac{1}{\frac{N1}{N2} + \frac{N2}{N1} + 2}$$

So it will be seen that a·(1−a) is directly expressed as a function of N1 and N2. So it suffices to determine the expression:

$$Q = \frac{1}{\frac{N1}{N2} + \frac{N2}{N1} + 2}$$

by means of known types of circuits (for example dividers, inverters, adders etc.) and to multiply for each value of Nt supplied by the counter 15 this value by Q (or by a coefficient proportional to Q in any constant ratio) or to divide this value by 1/Q if an estimate has been made of the expression of 1/Q, in order to obtain a value of Nt which is fully independent of a, d1 and d2.

The evaluation circuit 35 has therefore for its function to derive from the counter 15 the values N1 and N2 of the number of comparison signals, supplied by each of the two processing stages 3 and 23, and to determine the coefficient Q as a function of N1 and N2. The correction circuit 16 has for its function to multiply the total number Nt by this coefficient Q (or by a coefficient proportional thereto) in order to obtain a corrected value Ntq. This value Ntq is fully independent of a, that is to say of the distances between the moving object and each camera and is therefore only dependent on the actual dimensions of the detected moving object. The information on the position of the object derived from N1 and N2 and, consequently, due to the fact that there are two different groups of stages 2, 3 and 22, 23, renders it possible to determine a correction information which improves the efficiency of the monitoring system. The presence of the neutralizing arrangement 37 renders it possible to prevent, in a very efficient manner, the intervention device 17 from operating untimely owing to the passage of small animals through the monitored area 1 or similar causes which might accidentally actuate the intervention device.

As shown in FIG. 1, the monitoring system comprises a clock circuit (5 and 25) for each detection stage (2 and 22). It is alternatively possible to use one single clock circuit and further one single synchronizing signal generator for both cameras and one single circuit for distributing the field signals sequentially produced by the two detection stages. At the same time this single clock circuit ensures a sequential reproduction of the field recorded in the storage channels 9 and 29 of the processing stages 3 and 23. This solution, i.e. the use of one single clock circuit, synchronizing signal generator and distribution circuit is used when the two cameras are sufficiently near to one another to be able to use the common circuits. If, on the contrary, the cameras are situated so that a very wide monitored zone is covered and these cameras are at a very large distance from one another, each camera is preferably provided with its own clock circuit, its own synchronizing signal generator and its own distribution circuit.

It furthermore holds that the system shown in FIG. 1 is simultaneously operative at the processing stages 3 and 23. The stage 23 can, for example, be omitted if the information coming from the cameras 7 and 27 would be sequentially processed in the processing stage 3.

Although the selection of the fields to be compared can be done in any manner (by a suitable choice of the field members m, $n=m+i$, mentioned earlier in the description) two methods appear to be particularly interesting. If a rapidly moving object or a rapidly moving person must be detected, the time interval between the first field written into the store and the second field which is immediately forwarded to the comparison circuit 11 (or 31) will preferably be fixed at a value of, for example, less than one second. If, on the contrary, slower motions must be detected this time interval can be fixed at a value of more than one second.

For a motion of a similar amplitude which is performed quickly or slowly by two objects of substantially equal dimensions the number of comparison signals supplied by the counter 15 and sent to the threshold circuit 16 is therefore substantially identical, which is precisely what is intended. During a preceding sampling of the monitoring system it is, however, possible to ascertain that the absolute identity is not achieved. A small deviation does not affect the operation of the monitoring system if the number of supplied signals corresponds to an object size which is clearly above or clearly below the limit value at which the intervention device 17 is actuated. If, on the contrary, the two only slightly different numbers of comparison signals are near the threshold value of the threshold circuit 16, an uncertain situation is created as regards actuation or non-actuation of the system. Namely, one of the two numbers of comparison signals can be of such a nature that the intervention device 17 is actuated, whereas the other number of comparison signals does not effect actuation. To obviate this uncertainty the threshold value can be made variable, either manually, or by providing a device which changes this threshold value automatically when the time interval between the first and the second field is changed. By means of this control it is possible to ensure actuation of the system for the same dimension of the moving object, irrespective whether rapid or slower motions are detected.

The above-described monitoring system prevents an incorrect actuation of the system in a very efficient manner. The reliability of operation of the system can be increased by making this monitoring system insensitive to parasitic signals, that is to say by converting, as soon as this is possible during their processing, the fields of analog signals consecutively appearing at the output of the detection stages 2 and 22 into fields of digital signals. As this is a known technique it will not be further discussed here.

The present invention is of course not limited to the above-described and proposed embodiment. Other methods or embodiments can be derived therefrom without moving beyond the scope of the present invention.

The above-described monitoring system makes a selection from moving objects in the monitored area on the basis of their dimensions in a direction substantially perpendicular to the distance D, that is to say on the basis of the apparent surface of this object at the camera or cameras used. This selection can be perfected by monitoring the same area with an additional set of two cameras placed perpendicularly to the first set of two cameras and each being comprised in a detection stage as described above; these additional detection stages are also here connected to two additional processing stages each one supplying a certain number of comparison signals (N3 and N4, respectively) to the same above-mentioned counter 15.

In these circumstances the total number of comparison signals $Nt=N1+N2+N3+N4$, present at the output of the counter 15 directly relates to on the one hand the apparent surface of the moving object before the first two cameras 7 and 27 and, on the other hand, the apparent surface of the same object before the two additional cameras arranged perpendicularly to the first two cameras. This four-camera monitoring system furnishes a particularly accurate indication about the dimensions, because it is related to the dimensions of the object in two substantially perpendicular planes.

Throughout the preceding description it was assumed that the comparison circuit 11 (or 31) provided at the output of the parallel channels 9 and 10 (29 and 30) would furnish comparison signals only when the signals of the same order of the two compared fields would be different. It is alternatively possible to realize a monitoring system based on the complementary principle, that is to say a system in which the comparison circuit 11 and 31, respectively, produces comparison signals only when the signals of the same order of the two compared fields are identical. The total number of comparison signals is then compared with the threshold value of the threshold circuit 16 and causes actuation of the intervention device 17 only if this number is below this value.

It may be desirable for the threshold circuit 16 to control alternately different intervention devices 17 depending on the value of the total number of comparison signals counted by the counter 15. To this end the threshold circuit 16 is provided with different threshold values which are mutually shifted with respect to one another and, depending on the area in which the total number of comparison signals is present either the one or the other intervention device (17) starts operating.

It is further possible to provide the intervention device (17) with a television display device adapted to the monitoring system, a camera signal being applied to the television display device when motion is detected.

What is claimed is:

1. A monitoring system for monitoring a field for the detection of motion of objects within a given area, the system comprising a detection stage provided with a camera for signal recording with respect to the area to be monitored, a processing stage provided with a storage device and a comparison circuit for producing comparison signals in dependence on differences and signal agreements, respectively, between signals produced by the camera and delayed and not delayed in the storage device, said comparison circuit comprising a selective switching-on stage having an intervention device actuated in dependence on the number of comparison signals, wherein the system comprises at least two cameras spaced apart and being arranged at a different angle with respect to the area to be monitored by the cameras, each camera being connected through a processing stage to said, single, selective switching-on stage which further comprises means for adding together the comparison signals derived from the different camera signals, and a threshold device coupled between the intervention device and an output of the adding means delivering the sum of the comparison signals.

2. A monitoring system as claimed in claim 1, wherein the two cameras are arranged in a more or less opposite direction with respect to the area to be monitored.

3. A monitoring system as claimed in claims 1 or 2, wherein the system comprises four cameras which are successively arranged at square angles with respect to the area to be monitored.

4. A monitoring system as claimed in claim 3, wherein the system further comprises an arrangement for neutralizing the influence of the mutual distances between a moving object in the monitored area and each individual camera on the result of the count of the total number of comparison signals, this arrangement comprising a counter coupled to said comparison circuit for counting the number of comparison signals, an evaluation circuit for deriving from the counter the number of comparison signals which are supplied sequentially or simultaneously by one common or two separate processing stages, respectively, and for determining, in dependence on the two values thus derived, a coefficient which is inversely proportional to the mathematical expression of the total number of comparison signals present at the output of the counter as a function of the mutual differences, which are at right angles to the axis between the two cameras, between the moving object and each individual camera, and a correction circuit suitable for multiplying this mathematical expression of the total number of comparison signals by this coefficient.

5. A monitoring system as claimed in claim 4, wherein the system further comprises a clock circuit, one synchronizing signal generator for the cameras and one circuit for distributing the field signals which are sequentially supplied by the cameras included in the detection stages.

6. A monitoring system as claimed in claim 5, wherein the threshold value of the threshold circuit present in the selective switching-on stage is controllable in dependence on the period of time during which a first field signal, produced by the camera and supplied by each detection stage to the storage device of the associated processing stage, is retained in the storage device.

* * * * *